US008438866B2

(12) United States Patent
Kim et al.

(10) Patent No.: US 8,438,866 B2
(45) Date of Patent: May 14, 2013

(54) DEFROSTING APPARATUS OF REFRIGERATOR

(75) Inventors: Kyeong Yun Kim, Seoul (KR); Nam Soo Cho, Seoul (KR); Su Nam Chae, Seoul (KR); Jang Seok Lee, Seoul (KR); Youn Seok Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 577 days.

(21) Appl. No.: 12/593,458

(22) PCT Filed: Mar. 25, 2008

(86) PCT No.: PCT/KR2008/001663

§ 371 (c)(1),
(2), (4) Date: Sep. 28, 2009

(87) PCT Pub. No.: WO2008/120887

PCT Pub. Date: Oct. 9, 2008

(65) Prior Publication Data

US 2010/0147002 A1 Jun. 17, 2010

(30) Foreign Application Priority Data

Mar. 30, 2007 (KR) ..... 10-2007-0031575

(51) Int. Cl.
*F25D 21/06* (2006.01)
*F25D 17/04* (2006.01)

(52) U.S. Cl.
USPC ..... 62/151; 62/186; 62/275

(58) Field of Classification Search ..... 62/81, 275, 62/276, 428, 153, 80, 151, 178, 180, 186
See application file for complete search history.

(56) References Cited

U.S. PATENT DOCUMENTS

| | | | | | |
|---|---|---|---|---|---|
| 3,000,186 | A * | 9/1961 | Mann | 62/153 |
| 3,182,467 | A * | 5/1965 | Beckwith | 62/256 |
| 4,152,900 | A * | 5/1979 | Chopra et al. | 62/80 |
| 5,787,725 | A * | 8/1998 | Shin | 62/443 |
| 5,826,442 | A * | 10/1998 | Lee | 62/283 |
| 5,899,079 | A * | 5/1999 | Dunnigan et al. | 62/80 |
| 6,626,004 | B2 * | 9/2003 | Lee | 62/276 |
| 2002/0184904 | A1 * | 12/2002 | Wellman | 62/186 |
| 2004/0123610 | A1 * | 7/2004 | Nowak et al. | 62/187 |
| 2005/0279119 | A1 * | 12/2005 | Sim et al. | 62/419 |
| 2007/0000271 | A1 * | 1/2007 | Lee et al. | 62/276 |

FOREIGN PATENT DOCUMENTS

| | | |
|---|---|---|
| DE | 198 59 985 | 6/2000 |
| JP | 10-232089 | 9/1998 |
| KR | 10-1998-085095 A | 12/1998 |
| KR | 10-2001-0060677 A | 7/2001 |
| WO | WO 2005/052474 | 6/2005 |

OTHER PUBLICATIONS

International Search Report dated Sep. 2, 2008.
Korean Office Action dated Jun. 2, 2008 issued in Application No. 10-2007-0031575.

* cited by examiner

*Primary Examiner* — Marc Norman
(74) *Attorney, Agent, or Firm* — KED & Associates LLP

(57) ABSTRACT

A defroster is provided in a refrigerator, in which a damper mounted to an inlet to a circulating duct controls air to flow in a reverse direction toward an evaporator to maximize a defrosting efficiency by using not only radiant heat but also convective heat. The defroster includes the evaporator, a heater that defrosts the evaporator by radiation, and a flow controller that controls air circulated by a fan to flow in a reverse direction toward the evaporator in defrosting.

12 Claims, 3 Drawing Sheets

DEFROSTING APPARATUS OF REFRIGERATOR

TECHNICAL FIELD

The present invention relates to defrosters. More specifically, the present invention relates to a defroster in a refrigerator which can defrost entire evaporator uniformly by using heat convection male by a fan in addition to heat radiation.

BACKGROUND ART

In general, the refrigerator is provided with a compressor for elevating a temperature and a pressure of low temperature, low pressure gaseous refrigerant to a high temperature and high pressure gaseous refrigerant, and a condenser for cooling and condensing the high temperature and high pressure gaseous refrigerant into liquidus refrigerant by using heat exchange with outdoor air.

In addition to this, the refrigerator is provided with a capillary tube having a diameter smaller than a diameter of other parts for decompressing the refrigerant introduced thereto from the condenser, and an evaporator for evaporating the refrigerant from the capillary tube to low temperature and low pressure refrigerant for absorbing heat from an inside of the refrigerator.

The refrigerator is also provided with a freezing chamber having cold air introduced thereto from the evaporator directly for maintaining a chamber temperature of about −18° C., and a refrigerating chamber having the cold air introduced thereto from the freezing chamber for maintaining a chamber temperature of about 0~7° C.

There are a machinery room on a lower portion of a rear side of the refrigerating chamber having the compressor and the condenser mounted thereto, and a cold air supply unit in rear of the freezing chamber isolated therefrom with a rear wall thereof having a cooling fan for forced blow of the cold air from the evaporator to the freezing chamber and a defrosting heater for removing frost from a surface of the evaporator mounted thereto.

In the meantime, because, while a temperature of a surface of the evaporator is low, a temperature surrounding the evaporator is relatively high, dew drops are formed on the surface of the evaporator due to a temperature difference therebetween, and frozen by the temperature of the surface of the evaporator to form the frost.

There are two kinds of the defrosting heaters; one is a convection type heater which has no direct contact with the evaporator, and the other one is a radiation type heater which is in contact with the evaporator. Either one or both of them can be applicable to the refrigerator.

However, referring to FIG. 3, since the refrigerator with the radiation type heater has the compressor and the fan (not shown) turned off and only the heater 1 turned on for defrosting by using radiant heat, the refrigerator has a size limit of the evaporator 2 in a longitudinal direction, and a problem in that the defrosting can not be done appropriately if the evaporator 2 is located high.

Unexplained numerals in the drawing are heat exchanger tube 3, cooling fins 4, a liquid separator 5, and air (heat) flow V.

DISCLOSURE OF INVENTION

Technical Problem

To solve the problems, an object of the present invention is to provide a defroster in a refrigerator which can defrost even an upper portion of the evaporator uniformly without a longitudinal direction size limit thereof in defrosting the evaporator with a radiation type defrosting heater.

Technical Solution

To achieve these objects and other advantages and in accordance with the purpose of the invention, as embodied and broadly described herein, a defroster in a refrigerator includes an evaporator, a heater for defrosting the evaporator by radiation, and flow control means for controlling air circulated by a fan to flow in a reverse direction toward the evaporator in the defrosting.

Preferably, the flow control means is a damper mounted to an inlet to the circulating duct having cold air circulated therethrough.

The heater is a sheath heater mounted under the evaporator.

In another aspect of the present invention, a defroster in a refrigerator includes a cold air supply portion having an evaporator and a fan mounted therein, a heater for defrosting the evaporator by radiation, a circulating duct for guiding cold air from the cold air supply portion to a refrigerating chamber and/or a freezing chamber, and flow control means mounted to the circulating duct so that air flows in a reverse direction from the air supply portion toward the evaporator by the fan in the defrosting.

Preferably, the flow control means is a damper mounted to an inlet to the circulating duct having cold air circulated therethrough.

Advantageous Effects

The defroster in a refrigerator of the present invention can maximize defrosting efficiency because not only radiant heat but also convective heat is utilized in a case a radiant type heater is used for the defrosting to make uniform defrosting up to an upper portion of the evaporator without being limited by a longitudinal size of the evaporator.

BRIEF DESCRIPTION OF THE DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

MODE FOR THE INVENTION

Reference will now be male in detail to the specific embodiments of the present invention, examples of which are illustrated in the accompanying drawings. Wherever possible, the same reference numbers will be used throughout the drawings to refer to the same or like parts.

Figure 1:
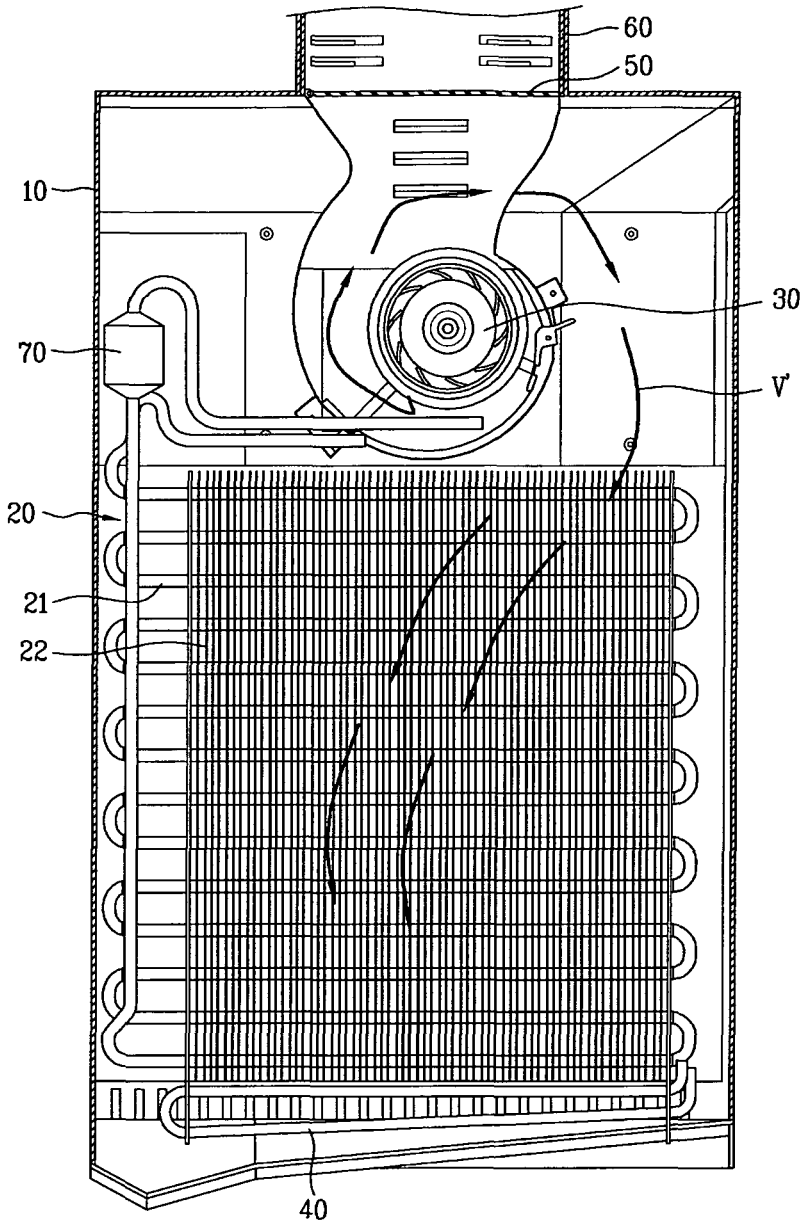
FIG. 1 illustrates an operation state in defrosting of a refrigerator in accordance with a preferred embodiment of the present invention.
Figure 2:
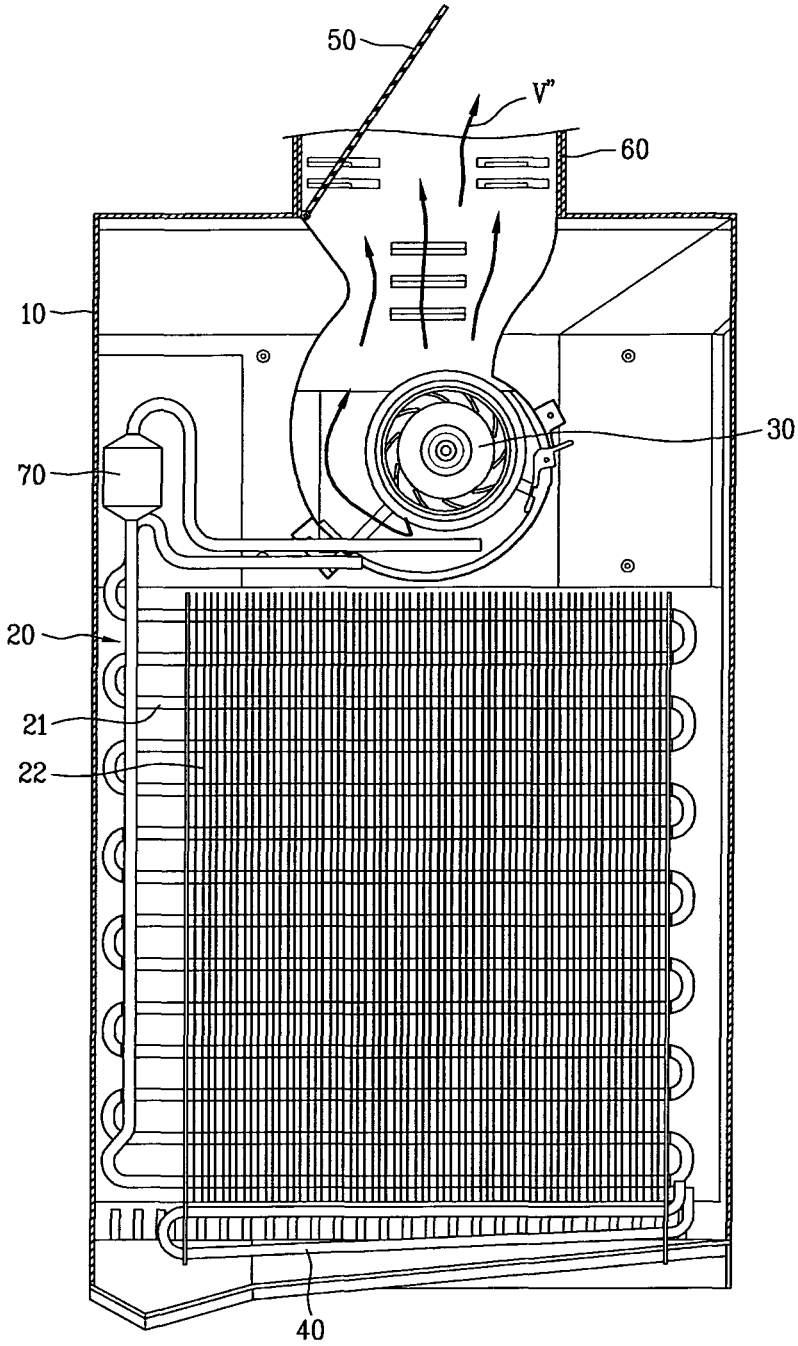
FIG. 2 illustrates an operation state in none operation of a defroster in a refrigerator in accordance with a preferred embodiment of the present invention.
Figure 3:
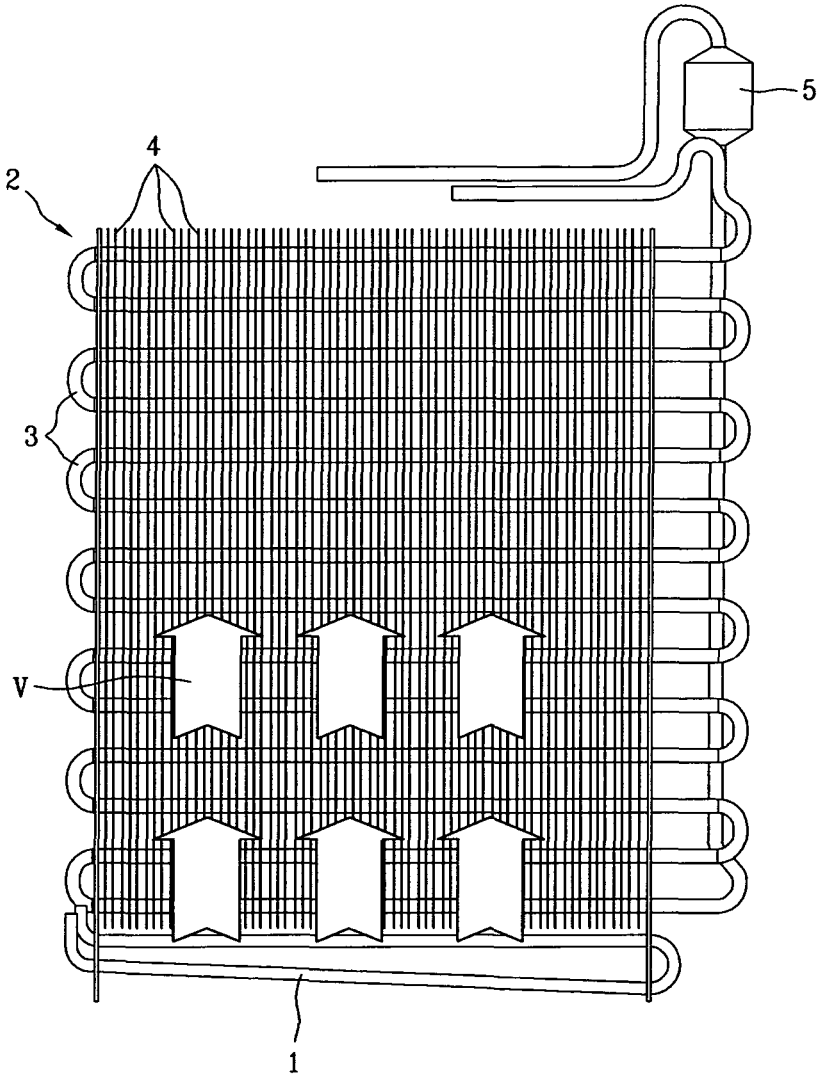
FIG. 3 illustrates an operation state in defrosting of a related art refrigerator.

Referring to FIGS. 1 and 2, the defroster in a refrigerator of the present invention includes an evaporator 20, a fan 30, a radiation type heater 40, and flow control means 50, mounted in a cold air supply portion 10.

Mounted in the cold air supply portion 10 located on one side of a freezing chamber wall, there are an evaporator 20 for generating cold air, a fan 30 for circulating the cold air, and a heater 40 for defrosting the evaporator 20.

Connected to an upper side of the cold air supply portion 10, there is a circulating duct 60 for guiding the cold air to the freezing chamber and the refrigerating chamber, with flow control means 50 mounted thereto for opening/closing an air flow passage to the cold air supply portion 10 and closing the air flow passage for reversing the air toward the evaporator 20 by driving the fan 30 in defrosting.

Referring to FIGS. 1 and 2, the flow control means 50 may be a damper hinged at an inlet of the circulating duct 60 for opening/closing the flow passage. Variations of the damper may be possible as far as the damper can close the flow passage, such as a sliding type of damper that can slidably close the flow passage at the inlet of the circulating duct 60.

In order to accelerate supply of the heat toward the evaporator 20 in the defrosting, A guide portion (not shown) may be mounted to the cold air supply portion 10 additionally, which is extended from a fan outlet to a lower portion thereof.

During the defrosting, the evaporator 20 is turned off. Though a fin-tube type evaporator is shown in the drawing, having a meander of repeatedly bent copper heat exchanger tube 21 with aluminum cooling fins 22 closely inserted on an outside of the tube 21, a coaxial type or jacket type heat exchanger may be used as required.

The fan 30 may be a sirocco fan for circulating the cold air from the cold air supply portion 10 to the freezing chamber and/or the refrigerating chamber, and different from the related art defroster, is turned on in the defrosting to accelerate an air flow within the air supply portion 10 toward the evaporator 20.

It is preferable that the heater 40 under the evaporator 20 is a radiation type sheath heater having a coil in a metallic sheath pipe with magnesium oxide filled between the sheath pipe and the coil for electric insulation between the sheath pipe and the coil.

An unexplained numeral 70 denotes an accumulator for separating liquid refrigerant from gas introduced thereto to prevent liquid back to the compressor for protecting the compressor, thereby preventing turbulence of the liquid in the evaporator.

The operation of the defroster in a refrigerator of the present invention will be described.

Referring to FIG. 1, in the defrosting for removing frost from the surface of the evaporator 20, the inlet to the circulating duct 60 is closed with the damper at the inlet of the circulating duct 60, the evaporator 20 is turned off, and the heater 40 is turned on.

Different from defrosting of the related art refrigerator, if the fan 30 is turned on to accelerate an air flow within the cold air supply portion 10, the air heated at the heater 40 can not be drawn into the circulating duct 60 due to the damper which is the flow control means 50, but flows in a reverse direction toward the evaporator 20, thereby melting the frost.

At the end since not only radiant heat is utilized as the air heated at the heater 40 moves upward but also convective heat is utilized as the air flows in a reverse direction within the cold air supply portion 10 owing to the fan 30 and the damper, the defrosting efficiency can be improved sharply without being limited by a longitudinal size of the evaporator 20.

In the meantime, referring to FIG. 2, when the defrosting is not performed since the damper which is the flow control means 50 leaves the inlet to the circulating duct 60 opened while the fan 30 is operated the cold air (V) is supplied from the evaporator 20 to the freezing chamber and/or the refrigerating chamber through the circulating duct 60.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A defroster in a refrigerator comprising:

an evaporator;

a heater that defrosting the evaporator by radiation;

a fan mounted above the evaporator; and flow control device that controls air circulated by a fan to flow in a reverse direction toward the evaporator during a defrosting operation, wherein the heater is mounted under the evaporator, wherein the fan is a sirocco fan, and wherein the fan rotates in the same direction both during the defrosting operation and during a normal operation.

2. The defroster as claimed in claim 1, wherein the flow control device comprises a damper mounted to an inlet to the circulating duct having cold air circulated therethrough.

3. The defroster as claimed in claim 2, wherein the damper is hinged at the inlet of the circulating duct and close the inlet of the circulating duct during the defrosting operation so that the air circulated by the fan flows in the reverse direction toward the evaporator.

4. The defroster as claimed in claim 2, wherein during the defrosting operation, the flow control device close the inlet to the circulating duct, the evaporator is turned off, the heater is turned on the fan is turned on.

5. The defroster as claimed in claim 1, wherein the heater is a sheath heater.

6. The defroster as claimed in claim 1, wherein the evaporator comprises a fin-tubes type evaporator.

7. A defroster in a refrigerator comprising:

a cold air supply portion having an evaporator and a fan mounted therein;

a heater for defrosting the evaporator by radiation;

a circulating duct for guiding cold air from the cold air supply portion to at least one of a refrigerating chamber or a freezing chamber; and flow control means mounted to the circulating duct so that air flows in a reverse direction from the cold air supply portion toward the evaporator by the fan during a defrosting operation, wherein the fan is mounted above the evaporator, wherein the heater is mounted under the evaporator, wherein the fan is a sirocco fan, and wherein the fan rotates in a same direction both during the defrosting operation and during a normal operation.

8. The defroster as claimed in claim 7, wherein the flow control device comprises a damper mounted to an inlet to the circulating duct having cold air circulated therethrough.

9. The defroster as claimed in claim 8, wherein the damper is hinged at the inlet of the circulating duct and closes the inlet of the circulating duct during the defrosting operation so that the air circulated by the fan flows in the reverse direction toward the evaporator.

10. The defroster as claimed in claim 8, wherein during the defrosting operation, the flow control device closes the inlet to the circulating duct, the evaporator is turned off, the heater is turned on, and the fan is turned on.

11. The defroster as claimed in claim 7, wherein the evaporator comprises a fin-tubes type evaporator.

12. The defroster as claimed in claim 7, wherein the heater comprises a sheath heater.

* * * * *